US005382105A

United States Patent [19]

Iguchi et al.

[11] Patent Number: 5,382,105

[45] Date of Patent: Jan. 17, 1995

[54] PRINTER WITH AUTOMATIC CUTTER

[75] Inventors: Kesayoshi Iguchi, Fujisawa; Masahiro Yamaguchi, Yokohama, both of Japan

[73] Assignee: Matsushita Electric Industrial Co., Ltd., Osaka, Japan

[21] Appl. No.: 941,701

[22] Filed: Sep. 8, 1992

[30] Foreign Application Priority Data

Sep. 19, 1991 [JP] Japan ..... 3-239194

[51] Int. Cl.[6] ..... B41J 11/66

[52] U.S. Cl. ..... 400/621; 400/611

[58] Field of Search ..... 400/621, 611, 578, 582, 400/583, 583.1-583.4

[56] References Cited

U.S. PATENT DOCUMENTS 4,765,765 8/1988 Futakata ..... 400/583
4,957,381 9/1990 Sakai et al. ..... 400/583
5,099,290 3/1992 Yokota ..... 400/583.4

FOREIGN PATENT DOCUMENTS 0221066 9/1988 Japan ..... 400/621

OTHER PUBLICATIONS

Heybruck "Multi-Function Operator Panel", IBM Technical Disclosure Bulletin vol. 27, No. 7B Dec. 84.
Epson, User's Guide For Model LQ-570 Printer, pp. 3-5 (1991).

*Primary Examiner*—Edgar S. Burr
*Assistant Examiner*—Anthony H. Nguyen
*Attorney, Agent, or Firm*—Stevens, Davis, Miller & Mosher

[57] ABSTRACT

A printer with an automatic cutter, at the time when a printer power source is turned on, judges from the ON/OFF states of two keys, i.e. a paper feed key and a condition setting key, whether a selected mode is an automatic cutter test mode, a printing test mode, or a normal printing mode, and then effects a necessary processing in accordance with such selected mode. According to this processing, the test of the automatic cutter can be conducted using only the printer, that is, without the use of any special device and parts.

2 Claims, 3 Drawing Sheets

PRINTER WITH AUTOMATIC CUTTER

BACKGROUND OF THE INVENTION

1. Field of the Invention

This invention relates to a printer with an automatic cutter for cutting paper.

2. Description of the Related Art

FIG. 3 shows a conventional method of testing a printer with an automatic cutter. In FIG. 3, reference numeral 31 denotes a testing device for testing the printer 33, and reference numeral 32 denotes a connection cable for supplying test data from the testing device 31 to the printer 33 to be tested. Various kinds of tests for the printer 33 of FIG. 3 include a printing test, a lamp test and an automatic cutter test, and so on. Particularly, to ensure a proper operation of the automatic cutter after assembling the printer, it is necessary to operate the automatic cutter at least several tens of times for testing purposes. The other tests need to be done only once, and therefore should preferably be conducted independently of the automatic cutter test from the viewpoint of efficiency. In this manner, the test data for the automatic cutter test and the test data for the other tests may be fed from the testing device separately from each other.

FIG. 4 shows another conventional equipment for testing a printer, using only the printer. In FIG. 4, reference numeral 42 denotes the printer, and reference numeral 41 denotes switches for setting test items. A test program for the printer is activated, and a desired test item is selected by the switch or switches 41. For stopping the test, a power source is turned off, or the setting of the switches is changed. Thus, various tests can be conducted independently of one another even by using only the printer.

However, in the conventional method of FIG. 3, the specially-designed testing device is needed, and therefore there has been encountered a problem that the continuous test of the automatic cutter can not be conducted at places where this testing device is not provided. The conventional test method of FIG. 4 depending on the switches also suffers from a problem that special component parts for testing purposes must be provided.

SUMMARY OF THE INVENTION

With the above problems of the prior art in view, it is an object of the invention to provide a printer capable of testing an automatic cutter without the use of a special testing device or parts.

In the present invention, to achieve the above object, an automatic cutter test program-activating program and an automatic cutter test program, which are selectively executed in accordance with the condition of keys when a printer power source is turned on, are provided in a printer initializing program. With this arrangement, the test of the automatic cutter is conducted using only the printer.

With this arrangement, if a paper feed key and a condition setting key have both been depressed at the time when the printer power source is turned on, the automatic cutter test program is activated to thereby conduct the test of the automatic cutter, using only the printer.

BRIEF DESCRIPTION OF THE DRAWINGS

FIG. 2 is a flow chart of the processing when a power source of the printer of FIG. 1 is turned on;

DETAILED DESCRIPTION OF THE PREFERRED EMBODIMENT

Figure 1:
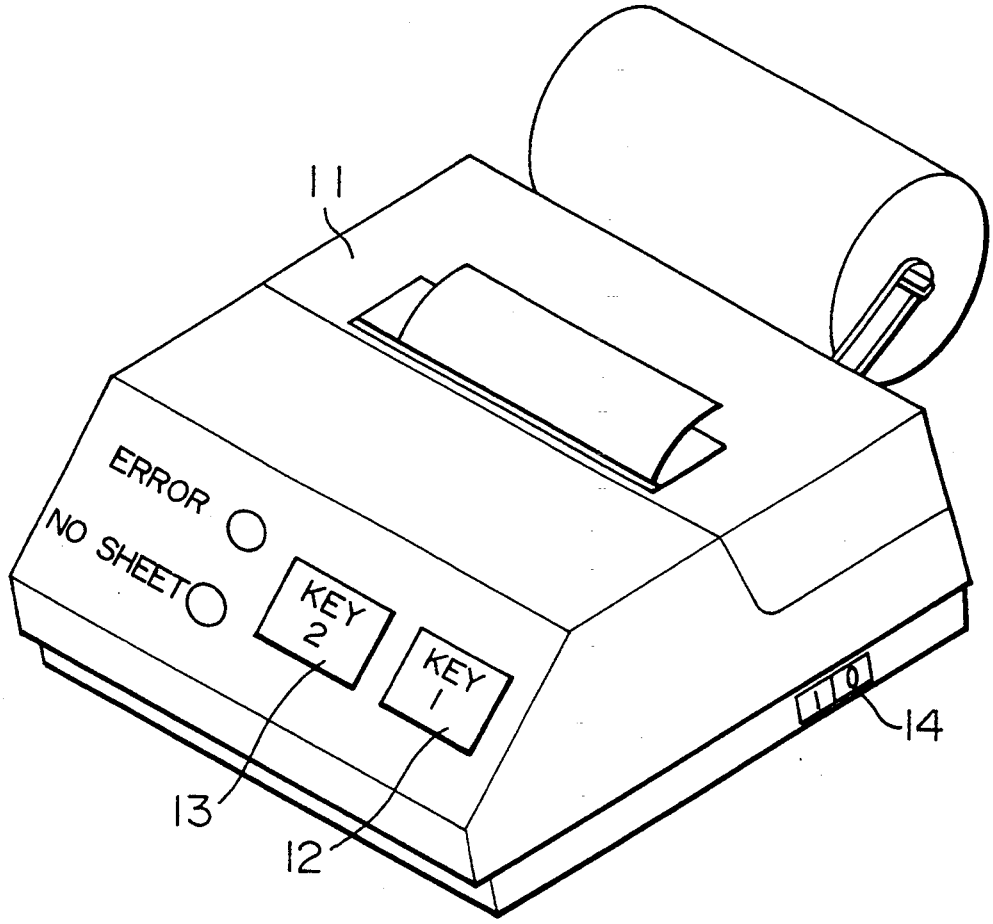
FIG. 1 is a perspective view of a printer with an automatic cutter provided in accordance with the present invention.

FIG. 1 shows a preferred embodiment of a printer of the present invention. A printer body 11 contains a printer, a cutter, and a controller for them, which are not shown. Reference numeral 12 denotes a first key switch 12 for feeding paper, reference numeral 13 a second key switch for setting the condition of the printer, and reference numeral 14 a power switch.

The relationship of the above structural elements, as well as the operation, will now be described. The first key switch 12 and the second key switch 13 are simultaneously depressed before the power switch 14 is turned on, and then the power switch 14 is turned on. If the first key switch 12 and the second key switch 13 have been simultaneously depressed when the power switch 14 is turned on, a program, incorporated in a processing unit in the controller (not shown) provided in the printer body 11, starts an automatic cutter test. If the first key switch 12 and the second key switch 13 have been simultaneously depressed after the start of the test, the automatic cutter test is started. After the start of the test, the first key switch 12 and the second key switch 13 are released. When the automatic cutter test is stopped, the second key switch 13 is depressed.

For conducting the printing test, the first key switch 12 is depressed before the power switch 14 is turned on, and then the power switch 14 is turned on.

Figure 2:
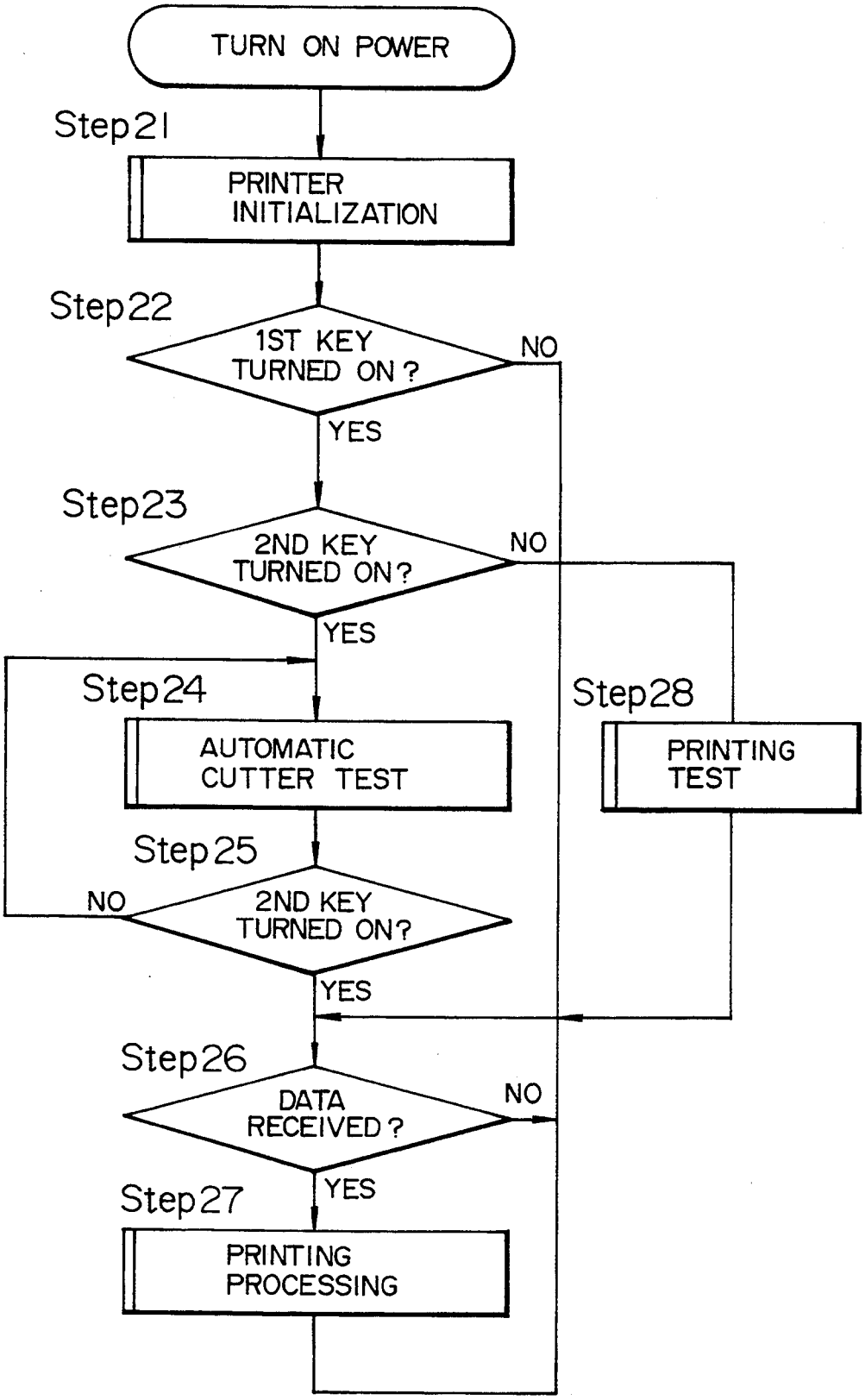
Figure 3:
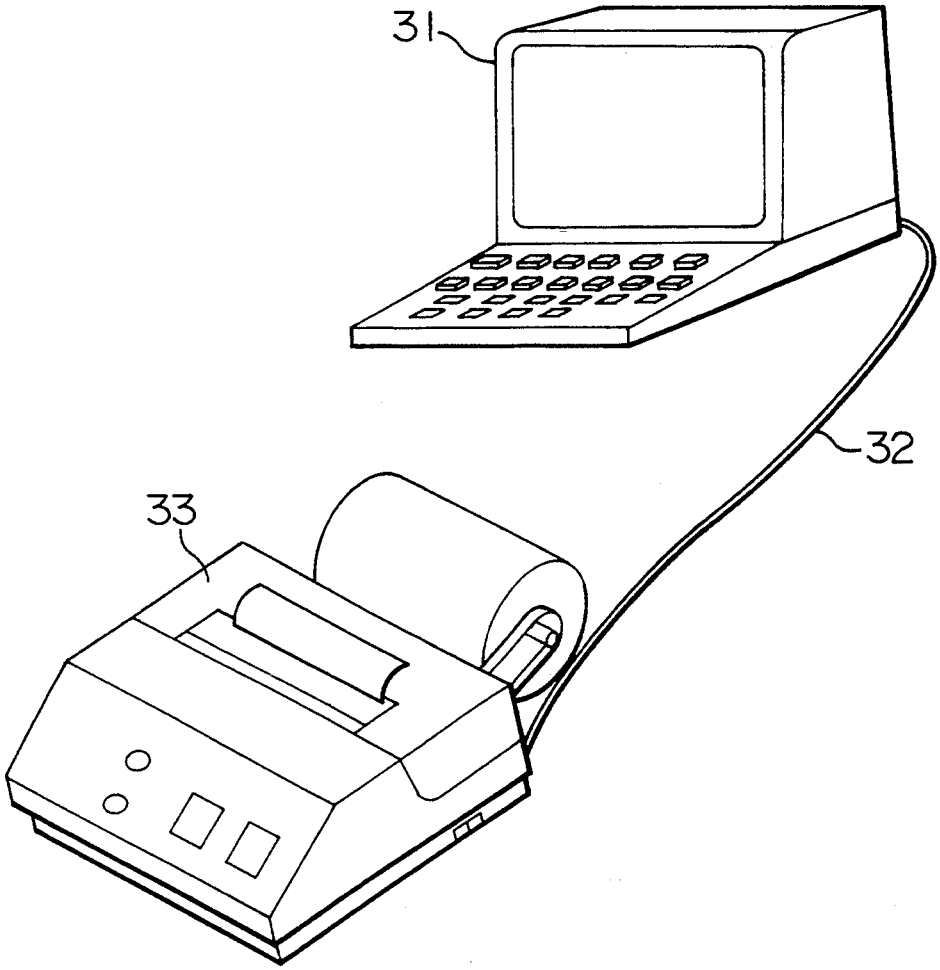
FIG. 3 PRIOR ART
FIG. 3 is a perspective view of a printer connected to a conventional testing device for testing an automatic cutter.
Figure 4:
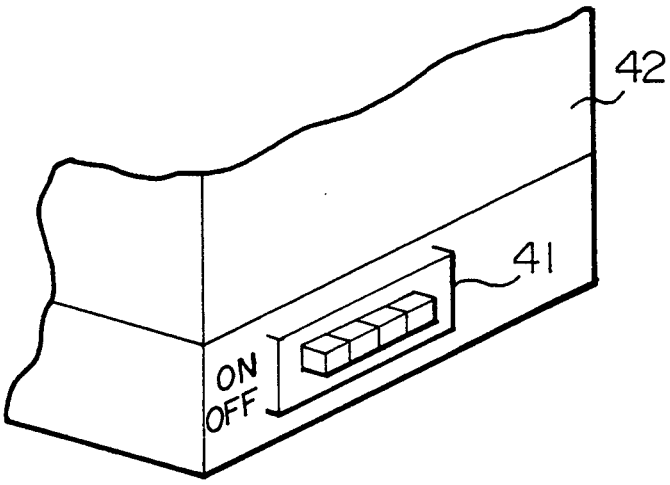
FIG. 4 PRIOR ART
FIG. 4 is a fragmentary perspective view of a printer having conventional switches for testing an automatic cutter.

FIG. 2 shows a flow chart of a logic arrangement for conducting the automatic cutter test, the printing test and other tests as mentioned above. This flow chart broadly show steps executed by an automatic cutter test program-activating program and an automatic cutter test program which are incorporated in the processing unit of the controller in the printer body 11. If both of judgment results in Steps 22 and 23 are "YES", the automatic cutter test is conducted (Step 24). If only the judgment result in Step 22 is "YES", the printing test is conduced (Step 28). If the judgment result in Step 23 is "NO", the normal printing condition is given (Steps 26 and 27).

As described above, the printer with the automatic cutter according to the present invention provides an advantage that by depressing the two keys at the same time, only the automatic cutter can be tested without the use of any special testing device or parts.

As is clear from the above embodiment, according to the present invention, the cutter test function is added to the printer with the automatic cutter. In order to enable the test of the cutter using only the printer, the special program performing the function of a processing unit is incorporated in the processing program (which is executed when the power source is turned on) in the controller, and the cutter can be tested without the use of any special device. Further, the above function can be achieved by combining such key switches as provided in an ordinary printer, and therefore there can be provided the printer with the automatic cutter which is capable of conducting the cutter test without the addition of any special parts.

What is claimed is:

1. A printer comprising:

an automatic cutter for cutting paper;

a paper feed key for feeding the paper;

a condition setting key for setting the condition of said printer; and a processing means for receiving ON and OFF signals from said paper feed and condition setting keys to process said ON and OFF signals and for testing said automatic cutter in accordance with the condition of said paper feed and condition setting keys.

2. A printer comprising:

an automatic cutter for cutting paper;

first key switch means;

second key switch means;

power switch means; and logic means, responsive to a turning on of said power switch means, for testing said automatic cutter when said first and second key switch means are simultaneously depressed before said power switch means is turned on, and for performing a printer test when only said first key switch means is depressed before said power switch is turned on.

* * * * *